US010111512B2

(12) United States Patent
Salciarini et al.

(10) Patent No.: US 10,111,512 B2
(45) Date of Patent: Oct. 30, 2018

(54) COSMETIC POT HAVING A LID WITH A TRANSLATIONALLY MOVED COUPLING ELEMENT

(71) Applicant: CHANEL PARFUMS BEAUTE, Neuilly-sur-Seine (FR)

(72) Inventors: Christian Salciarini, Hyeres (FR); Julien Chandelier, Longjumeau (FR); Gregory Perbal, Verrieres le Buisson (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 112 days.

(21) Appl. No.: 15/319,210

(22) PCT Filed: Jun. 29, 2015

(86) PCT No.: PCT/FR2015/051756

§ 371 (c)(1),
(2) Date: Dec. 15, 2016

(87) PCT Pub. No.: WO2016/001552

PCT Pub. Date: Jan. 7, 2016

(65) Prior Publication Data

US 2017/0127797 A1 May 11, 2017

(30) Foreign Application Priority Data

Jun. 30, 2014 (FR) ..... 14 56179

(51) Int. Cl.
*A45D 40/00* (2006.01)
*B65D 43/02* (2006.01)

(52) U.S. Cl.
CPC ..... *A45D 40/0068* (2013.01); *B65D 43/0225* (2013.01)

(58) Field of Classification Search
CPC ..... A45D 40/0068; B65D 43/0225; B65D 41/04; B65D 41/06; B65D 41/065
USPC ..... 220/290, 228, 292, 293, 295, 300, 301, 220/302, 304
See application file for complete search history.

(56) References Cited

U.S. PATENT DOCUMENTS

2004/0067091 A1 4/2004 Tsutsumi
2013/0092691 A1 4/2013 Sato et al.
2013/0334230 A1 12/2013 Jean-Francois Deluge et al.

FOREIGN PATENT DOCUMENTS

FR 2 969 127 A1 6/2012

*Primary Examiner* — Andrew Perreault
(74) *Attorney, Agent, or Firm* — Greenblum & Bernstein, P.L.C.

(57) ABSTRACT

A cosmetic pot having a base provided with an indentation on the neck, and a lid configured to be fastened to the base. The lid includes a plate and a cap that are configured to pivot with respect to one another. The cap includes a radial cam for translationally moving at least one coupling element between a first position in which a claw of the at least one coupling element is engaged in the indentation with the lid in the rest position and the pot closed, and a second position in which the at least one coupling element has been translationally moved with respect to the first position. The lid also includes at least one coupling return element configured to automatically return the at least one coupling element to the first position.

9 Claims, 8 Drawing Sheets

Fig.8
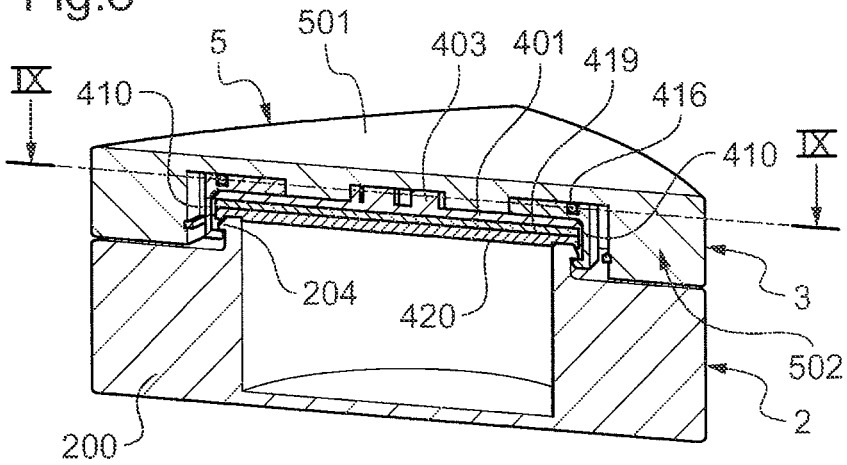
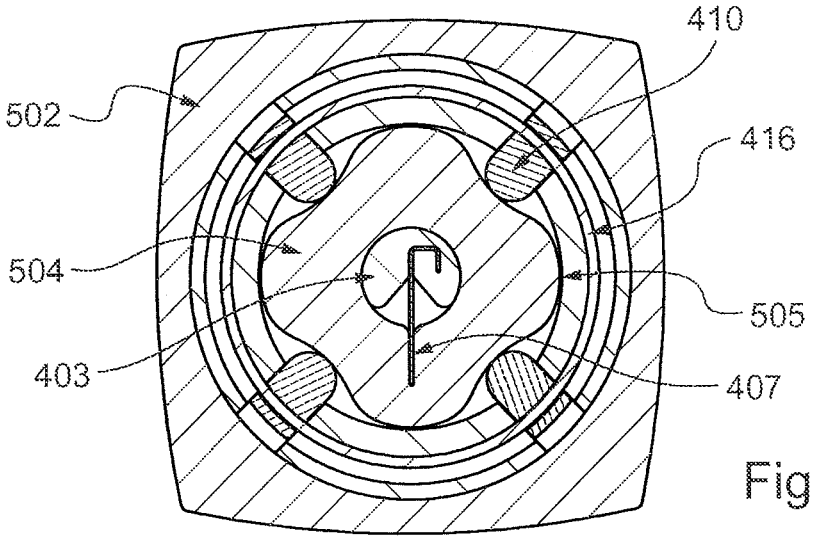
Fig.9
Fig.10
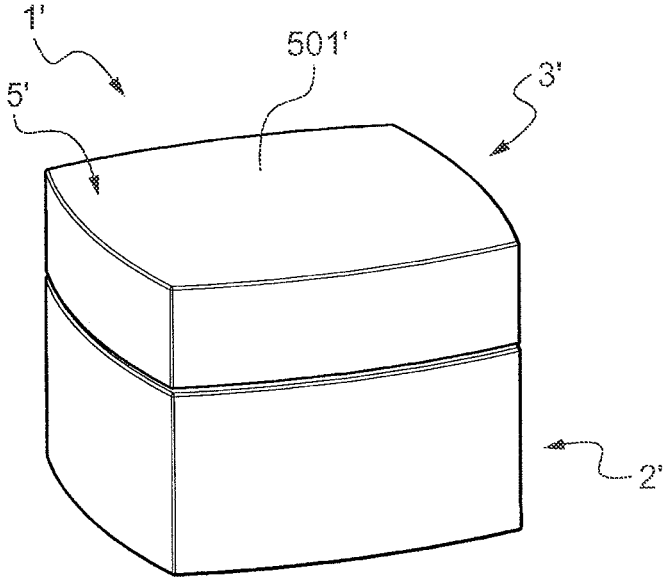

Fig.11
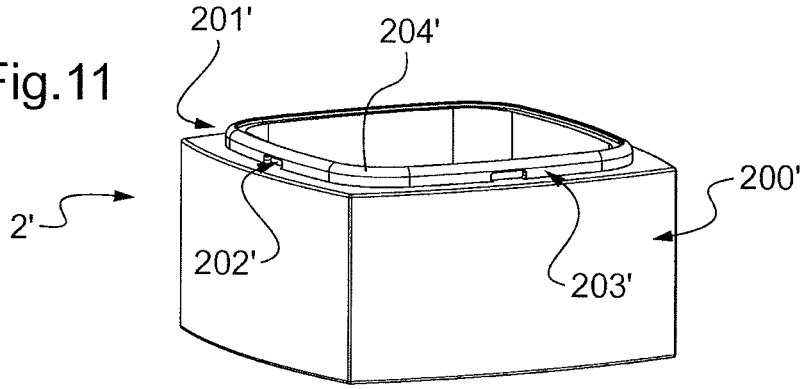
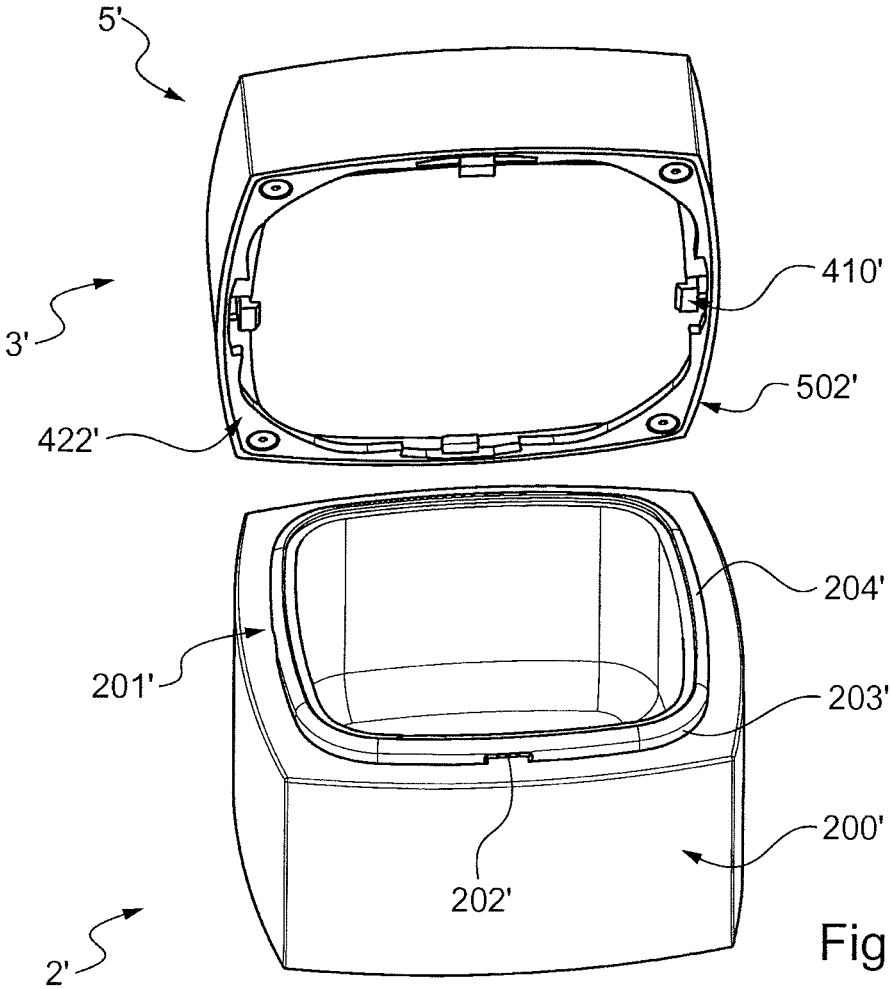
Fig.12

COSMETIC POT HAVING A LID WITH A TRANSLATIONALLY MOVED COUPLING ELEMENT

BACKGROUND

1. Field of the Invention

The present application concerns the field of pots, in particular cosmetic pots.

2. Background Information

Conventionally, a cosmetic product pot comprises a base, generally of glass or plastic, that is to say a container surmounted by a neck of which the size of the diameter is in the vicinity of the cross-section dimensions of the base, to have a wide opening. The base is closed by a lid, generally screwed onto the neck. The lid is furthermore generally equipped with a seal having the role of providing sealing for closing for good preservation of the product contained.

However, a drawback lies in the fact that the thread of the screw thread formation present on the neck requires there to be a neck clear from the rest of the base over a certain height and also a lid of a relatively great height; in other words the presence of the screw thread formation imposes constraints in terms of dimensions for the height of the neck and the thickness of the lid.

Moreover, in particular for a round pot which has no stop for screwing, a user who closes the pot has difficulty determining when the tightening of the lid on the base is right. Excessive tightening over time induces crushing of the seal. Insufficient tightening means that the seal does not provide proper sealing. In both cases, air can enter the pot or volatile products of the formula, that is to say of the product contained in the pot, can escape from the pot, such that a risk arises of the formula degrading over time.

For a pot of non-circular shape of which the base and the lid have identical contours, the pot often has a stop which limits the angular travel of the lid in relation to the base so as always to have coinciding shape between the base and the lid. The presence of the stop thus prevents over-screwing, and therefore compensating for a loss of sealing in case the seal is crushed.

The document US2004/0067091 is known for example which describes a bottle, typically for nail polish, which enables closing by clipping the cap onto the container and opening by pressing on at least one button acting on an elastic ring. A spring device furthermore enables fluid-tight closing of the bottle to be provided to avoid any spilling of the product it contains. Such a cap however has the drawback of being particularly bulky, and in particular engendering a relatively great height to house the device therein. Furthermore, such an embodiment is suitable for a bottle of which the neck has a small diameter, but could be difficult to apply to a pot of which the neck has an appreciably greater diameter.

SUMMARY

To solve at least some of the aforementioned drawbacks, the invention is directed to providing a pot with a lid that is simple to use to close or open a pot which enables reliability of closing to be ensured and which moreover leads to other advantages.

To that end, according to a first aspect, there is provided a cosmetic pot comprising a base and a lid to close the base, wherein:

the lid comprises an inside part, termed a coupling plate, and an outside part, termed a cap, the coupling plate and the cap being rotatably mounted in relation to each other, such that the lid is configured to adopt a resting position and an opening position in which the coupling plate and the cap are turned in relation to each other and in relation to the resting position;

the cap comprising a radial cam, the radial cam being defined by a profile forming at least one projecting active zone;

the coupling plate comprises:

a support;

at least one coupling member mounted on the support and movable in translation in relation to it, the at least one coupling member comprising a claw and a cam follower, the cam follower being in contact with the radial cam of the cap, the at least one coupling member being configured to adopt at least a first position when the lid is in resting position and a second position when the lid is in opening position, the second position being a position in which the cam follower of the coupling member cooperates with the at least one projecting active zone of the radial cam and in which the at least one coupling member, in the second position, is translated in relation to the first position;

at least one coupling return member linked to the at least one coupling member and to the support, the at least one coupling return member being configured to automatically bring the at least one coupling member back to the first position; and the base comprises a neck provided with at least one peripheral indentation, the claw of the at least one coupling member of the lid being engaged in the at least one indentation of the neck of the base when the lid is in resting position and the pot is closed.

There is considered here an indentation configured to form at least one longitudinal stop, that is to say in a vertical direction in relation to the pot, such that it is impossible to pull the lid to open the pot without turning it in order for the inside and outside parts to pivot in relation to each other to free the claw of a coupling member thus forming a hook, that is to say move it away from the neck so that it can be freed from the indentation.

A rotation of cap in relation to the coupling plate induces a movement of the claw enabling it for example to disengage from the indentation formed in the neck of the base. Provided no relative rotation is applied to the inside and outside parts of the lid, the lid is in resting position, and no force is applied to its various components. Wear of the lid is thus limited.

The opening of the pot is achieved by the relative rotation of the outside cap and of the inside plate, but any relative rotation between the inside plate and the neck of the pot base is very limited or even avoided, such that a seal that may be present operates mainly in compression, minimizing shear forces, very present in the case of a screwed lid.

The seal may be made of an adherent material, that is to say with poor slipping qualities. The sealing is thereby easier to achieve with efficiency and a large choice of materials and/or embodiments is possible for producing the seal.

Furthermore, the pot is aesthetic since it is possible to dispense with the screw thread formation on the neck. The dimensional constraints on the height of the neck and the thickness of the lid imposed by the presence of a screw thread formation can thereby be avoided.

Such a lid is also aesthetic because no part of its mechanism, with the possible exception of at least one claw, is visible to a user without recourse to dismantling the lid. Such a hidden mechanism enables a lid with an elegant shape to be procured.

The lid furthermore enables a high variability of volume, which enables different sizes to be produced, without being constrained by the bulk of the mechanism which it comprises, in particular in terms of height.

The lid is thus easily adaptable to any existing pot for example and may also be re-adapted later to another pot, of the same product or having a different capacity. This for example enables the lid to be customized and to be able to keep it in the course of using different pots, whether it be a pot of the same product, or of different products, whatever their capacity.

Furthermore, in contrast to a screwed lid, the neck here is not necessarily of circular cross-section. It is possible to have a neck with any particular shape, oval, oblong, square, polygonal or other shape, provided that the lid has a matching and/or adapted shape.

At the location of the radial cam of the cap, "projecting active zone" here designates the part of the cam that enables the cam follower to be pushed away, for example radially outwards. The projecting active zone has for example the shape of a lump or segment involute to a circle. In a particular embodiment, the cam profile has a regular contour to provide a more gentle rotational movement of the coupling plate in relation to the cap, without jolts.

The cam is situated towards the center of the lid. This produces a lever arm effect between the periphery of the lid and the zone in which the cam is located. On account of this, the torque that a user must apply between the base of the pot and the lid to induce the relative rotation of the cap in relation to the plate is small. Whatever the case, the torque is lower than for a conventional screwed lid in which the torque applied by the user must overcome the friction forces between the lid and the neck which are localized at the periphery of the lid.

The at least one coupling member in second position is thus translated in relation to the first position in a radial direction in relation to a center of rotation of the cam. Such a movement induced by the cam makes it possible to better ensure easy opening of the pot in use of the lid.

Thus, at least by the effect of friction, the coupling plate is held orientated on the neck when the cap is turned until the at least one claw disengages from the at least one indentation of the neck.

The pot is thus hermetically closed and can be opened by a simple and rapid manipulation, in particular on account of the fact that such a lid enables the pot to be opened with a movement potentially less than or equal to approximately a quarter turn (90°), or even approximately 45°, or even less for example such as approximately 15° or approximately 10°.

Once open, the pot is easily closed again by clipping of the lid. In other words, the pot is closed simply by replacing the lid and pressing on the lid in order for the coupling member to pass the rim of the neck and engage under the rim, in an indentation.

According to an advantageous arrangement, the lid comprises a position return member, the position return member being linked to the support of the coupling plate and furthermore being linked to the cap, such that the position return member is in a configuration referred to as "neutral" when the lid is in resting position and in a deformed configuration when the lid is in opening position, such that the position return member induces a counter-rotation of the cap in relation to the coupling plate when the lid is in opening position so as to bring the lid automatically back into resting position.

Such a position return member cooperates with the cam to facilitate the return to resting position of the lid. More particularly, the cam can be configured in order for the resting position to be a position of stable equilibrium of the upper part in relation to the lower part whereas the opening position can be an unstable position such that the lid naturally tends to return to resting position in which the mechanical forces of the various components of the lid are minimum. The presence of a position return member enables this aspect to be reinforced to promote the lid always returning to resting position.

However, according to another embodiment of construction, a lid is configured in order for the opening position also to be a stable position such that the lid can stay in opening position. For example, the at least one projecting active zone of the cam is configured to form a stable opening position. For example, the at least one projecting active zone comprises for this a flattened apex. Furthermore, a local deformation of the active zone may be provided which creates a point of increased resistance in opening position.

In this case, the pot is closed by placing the lid on the base and by turning it in relation to the base in the opposite direction to that which led to the opening.

According to a convenient exemplary embodiment, the position return member is a blade. The blade is for example held in a slot formed in the support of the coupling plate and also held in a slot formed in the cap. For example, the slot of the coupling plate and the slot of the cap are aligned in relation to each other when the lid is in resting position, or at least are configured such that the position return member is in a natural position, that is to say not deformed, when the lid is in resting position. The position return member also acts as a rotation travel limiter between the cap and the coupling plate of the lid.

Such a position return member is thus particularly easy to produce and to assemble with the other components of the lid.

According to an advantageous exemplary embodiment, the radial cam is a cam with an outside profile.

Such a cam thus makes it possible, for example, to push the at least one coupling member away outwardly, which facilitates gripping of the lid on the base for example with the claw positioned at an outer side of the neck of the base in order to be able to avoid contact of the claw with the product contained in the base, for better hygiene for example.

However, claws can be configured to be positioned at an inner side of the neck of the base or claws can be configured to be pushed in the other direction, that is to say towards the center of the pot, if the dimensions of the pots make such a configuration of the lid more convenient for example. To that end, a radial cam with an inside profile may then be employed.

According to a particularly advantageous example, the at least one projecting active zone of the radial cam has a plane of symmetry such that the cap and the coupling plate of the lid are configured to turn in relation to each other in a clockwise or anticlockwise direction, in the same way.

Such a lid thus enables a manipulation equally easy for a left-handed user or a right-handed user, by enabling the inside part to be turned in relation to the outside part in the same manner in one direction or the other.

According to an advantageous exemplary embodiment, the lid comprises at least two coupling members movable in translation, each comprising a claw and a cam follower in contact with the radial cam of the cap, and the cam comprises at least two projecting active zones, each coupling member being configured to adopt a first position when the lid is in resting position and a second position when the lid is in opening position, the second position of each coupling member being a position in which the cam follower of each coupling member cooperates with a corresponding projecting active zone of the radial cam and in which each coupling member, in second position, is translated in relation to the first position when the lid is in opening position.

In general, the cam has as many projecting active zones as there are coupling members, and each coupling member comprises a claw and a cam follower. All the coupling members, when the lid has at least two of them, are can be identical in a particular exemplary embodiment.

Furthermore, the cam is configured such that each projecting active zone has the same radius for each angle of rotation of the cap in relation to the coupling plate such that for a given angle of rotation, each corresponding coupling member is simultaneously moved through the same distance. This makes it possible to produce a clearly defined and easy opening of the pot when the lid is used.

The projecting active zones, like the coupling members, are disposed with regular spacing in relation to each other in a particular exemplary embodiment. Thus, in a case in which the lid comprises two coupling members and two projecting active zones on the cam, these can be diametrically opposite. Or, in a case in which the lid comprises four coupling members and four projecting active zones on the cam, these can be disposed every 90°, in a particular exemplary embodiment.

However, their respective dispositions may be irregular if the shape of the lid or of the pot for which it is provided so requires, provided that each coupling member is synchronized with a projecting active zone.

According to particularly convenient arrangements, when the lid comprises at least two coupling members and at least two corresponding projecting active zones on the cam, the lid comprises a single coupling return member configured to bring back at the same time each of the at least two coupling members automatically to the first position.

The presence of a single coupling return member better enables the synchronization of movement of each of the coupling members to be ensured. It furthermore facilitates the production of the lid by minimizing its number of components.

However, the various coupling members remain independent from each other. For example, if a coupling member were to become locked, this would not however constitute an obstacle to the proper operation of the other coupling members. In other words, the presence of a single coupling member enables them to be returned independently even though all their return movements are then synchronized.

Such a coupling return member is for example an annulus or a ring, for example of polymer or of elastomer, or for instance a metal spring, a blade spring or a tension spring. A coupling return member of annular form is for example disposed in a channel conjointly formed by a groove hollowed in the support of the coupling plate of the lid and in each coupling member so as to form a regular circle when the lid is in resting position. Thus, when the lid is in opening position, the elastic return member is then deformed and as a reaction tends to return the coupling members into their first position, and so return the lid into resting position.

Furthermore, the at least one indentation of the base neck is possibly continuous or discontinuous.

For example, the base comprises at least one rib configured to keep the coupling plate of the lid oriented in relation to the base when the at least one coupling member is in first position, with the lid on the base.

In a case of a pot with a circular contour in which the neck is also circular, rotational indexing of the lid in relation to pot base is generally not necessary. The indentation may then be continuous and thus form a channel all around the neck. The at least one coupling member may then engage in the indentation, which is then single, at any location.

However, for example if the pot has a non-circular contour involving position indexing of the lid in relation to the base (even if the neck is circular), the indentation is then possibly discontinuous. That is to say, the neck then for example comprises at least one rib, that is to say one or more rib(s), to serve as an orientation stop. Such a rib is thus suitable to limit the rotation of the lid in relation to the base. Thus, when the lid is turned in relation to the base to open the pot, the at least one rib locks its rotation and thus forces the cap to pivot in relation to the coupling plate. The at least one rib may also facilitate the positioning of the lid in relation to the base in the case for example in which the base and the lid must comply with a certain alignment in relation to each other. On closing, after having engaged the lid on the neck in order for the coupling members to enter the at least one indentation, the user then continues the rotation of the lid until the resistance is felt that is caused by the meeting of a coupling member with a rib. On releasing the lid, this is returned into its resting position which places it in the appropriate position in relation to the base. In the case of a single rib, there is however only one indentation even though this is then discontinuous. It is then for example possible for several coupling members to engage in the same indentation.

Thus, the base may comprise several indentations and several ribs if necessary, for example as many indentations as coupling members, the indentations being separated from each other by ribs.

According to a possible exemplary embodiment, each rib is flush with a peripheral rim of the neck, such that a coupling member in second position then simultaneously has the capacity to pass over a rib and the peripheral rim to disengage from its indentation.

According to another possible exemplary embodiment, each rib is set back in relation to a peripheral rim of the neck. In this case, the at least one coupling member possibly engages initially under the peripheral rim, facing a rib, then afterwards, while the lid is turned, more deeply into an indentation.

According to an advantageous embodiment, the width of each of the indentations is adjusted to receive a claw of a coupling member with an amount of play reduced to the operating play. In other words, the at least one indentation has a width substantially equal to a width of the claw of the corresponding coupling member. The "width" here designates the dimension along the circumference of the neck. With such an embodiment, the lid is positioned on the base in a limited number of angular positions, for example one position or four positions considering a case in which the neck would comprise four indentations. The four positions enable the lid to be positioned to coincide with the faces of the pot if this is square for example. A single position would correspond to the case in which the pot base and the lid would have a cross-section of asymmetrical or arbitrary shape and in which a single angular position of the lid on the pot would enable coinciding shape between the pot base and the lid. Furthermore, the neck may have a circular cross-section as previously or else a cross-section corresponding to the cross-section of the base. Thus, for example for a pot of square general cross-section, the neck possibly has a substantially square shape. In this case, the indentations are formed towards the middle of each of the sides of the square.

BRIEF DESCRIPTION OF THE DRAWINGS

The invention, according to exemplary embodiments, will be well understood and its advantages will be clearer on reading the following detailed description, given by way of illustrative example that is in no way limiting, with reference to the accompanying drawings in which:

FIG. 8 illustrates a cross-section view in perspective on a diagonal of the pot of FIG. 1;

FIG. 9 shows a cross-section view of the lid on the plane IX-IX of FIG. 8;

FIG. 10 presents a second exemplary embodiment of a cosmetic pot with a square contour which comprises a base and a lid aligned in relation to each other;

FIG. 11 presents the base of the pot of FIG. 10 according to a second embodiment of the present invention, comprising a neck of square shape;

FIG. 12 presents a perspective view of the pot of FIG. 10, open;

DETAILED DESCRIPTION

Identical parts represented in the aforementioned Figures are identified by identical numerical references.

The present description is given with reference to a pot of square contour but the invention embraces a pot of circular or arbitrary contour, as well.

Figure 1:
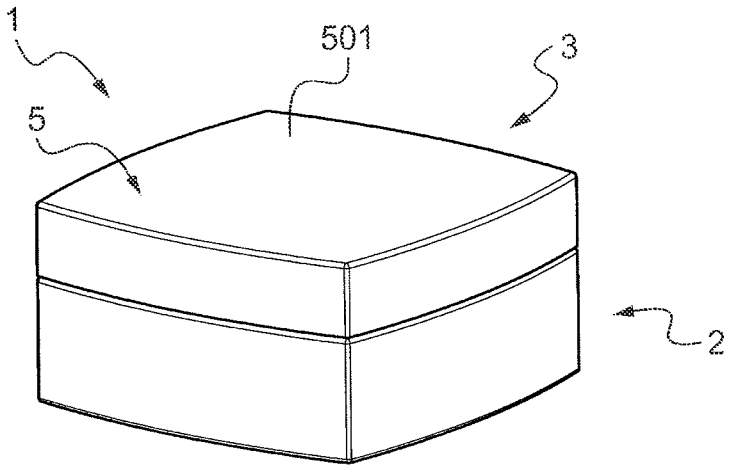
FIG. 1 shows a first exemplary embodiment of a cosmetic pot with a square contour that comprises a base and a lid that are aligned in relation to each other.

As a matter of fact, traditionally, a cosmetic pot 1 has a contour that is round, or substantially square, like that represented in FIG. 1.

The pot 1 comprises a base 2 and a lid 3 enabling the pot 1 to be opened or closed.

Figure 2:
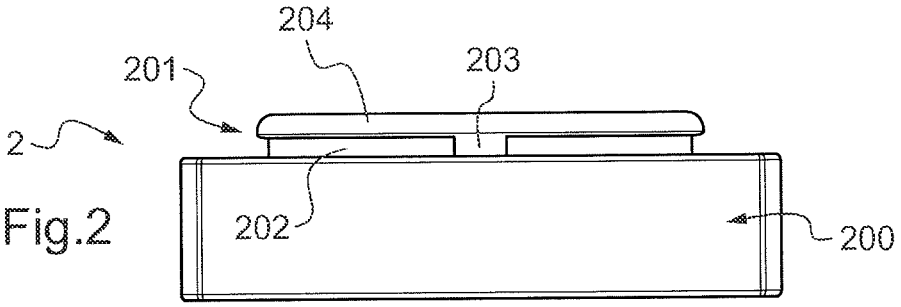
FIG. 2 presents the base of the pot of FIG. 1 according to a first embodiment of the present invention, comprising a neck of circular shape.

As shown in FIG. 2, the base 2 comprises a container 200 and a neck 201 which surmounts the container 200. The neck defines an opening which enables access to a product contained in the container 200. The dimensions of the neck and of the opening are in the vicinity of the cross-section dimensions of the base. Whatever the case, the opening of the pot is sufficiently wide to enable the passage of at least one finger of one hand, that is to say that it has a transverse cross-section dimension greater than or equal to approximately 25 millimeters.

The neck 201 here comprises one indentation 202 and one peripheral rim 204. In a particular embodiment, an upper part of the rim 204 is rounded or beveled to create a ramp effect if a member is moved vertically against the neck. In this exemplary embodiment, the neck 201 has a circular cross-section, but it may be otherwise as is described below, with reference to FIGS. 10 to 18 for example. The neck 201 thus here lacks any screw thread or screw ramp and compared to a conventional neck, it has a lower height. For example, by way of example, a square pot according to the invention has a height of approximately 95 mm with a neck having a height of approximately 6.3 mm, and with an indentation having a height of approximately 3.5 mm, and having a depth of approximately 15 mm. For a conventional pot of the same size, the height of the neck would have been of the order of 10.3 mm. These values are however given only by way of example.

The base 2 further comprises an optional rib 203. If present, such a rib 203 locally interrupts the indentation 202. In other words, the indentation 202 is then discontinuous and has at least one portion. Such a rib 203 is capable of laterally retaining a member engaged in the indentation 202 and passing therein and so forming an orientation stop. It may itself be set back in relation to the rim 204 or by a thickness equal to the depth of the indentation so as to be flush with the rim 204. The base 2 may furthermore possibly comprise several ribs 203, for example regularly distributed around the neck 201. The use of the rib or ribs 203 is described below.

The base is formed of any appropriate material, in particular glass or plastics material. It may be transparent or opaque. It may be provided to receive a mounted-on tub which contains the cosmetic product as in the case of a conventional pot.

Figure 3:
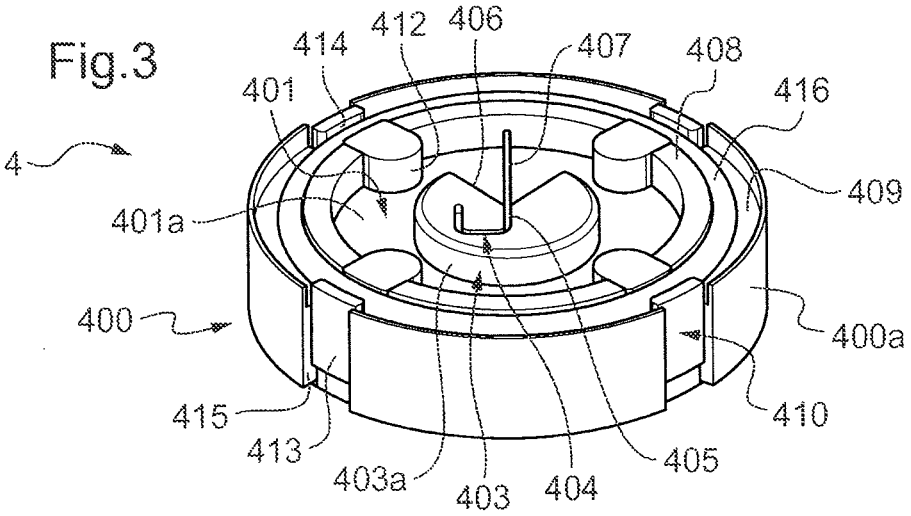
FIG. 3 presents a coupling plate of the lid of FIG. 1 according to a first embodiment of the present invention.
Figure 4A:
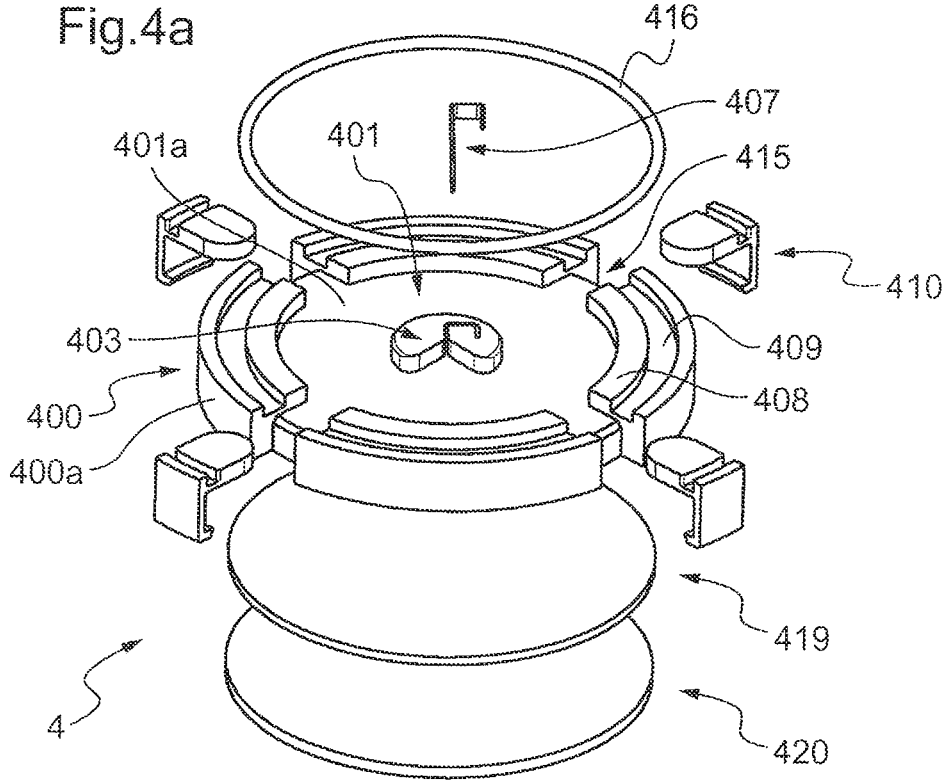
FIG. 4, composed of FIGS. 4*a* and 4*b*, presents an exploded view respectively from above and from below, of the coupling plate of FIG. 3.
Figure 4B:
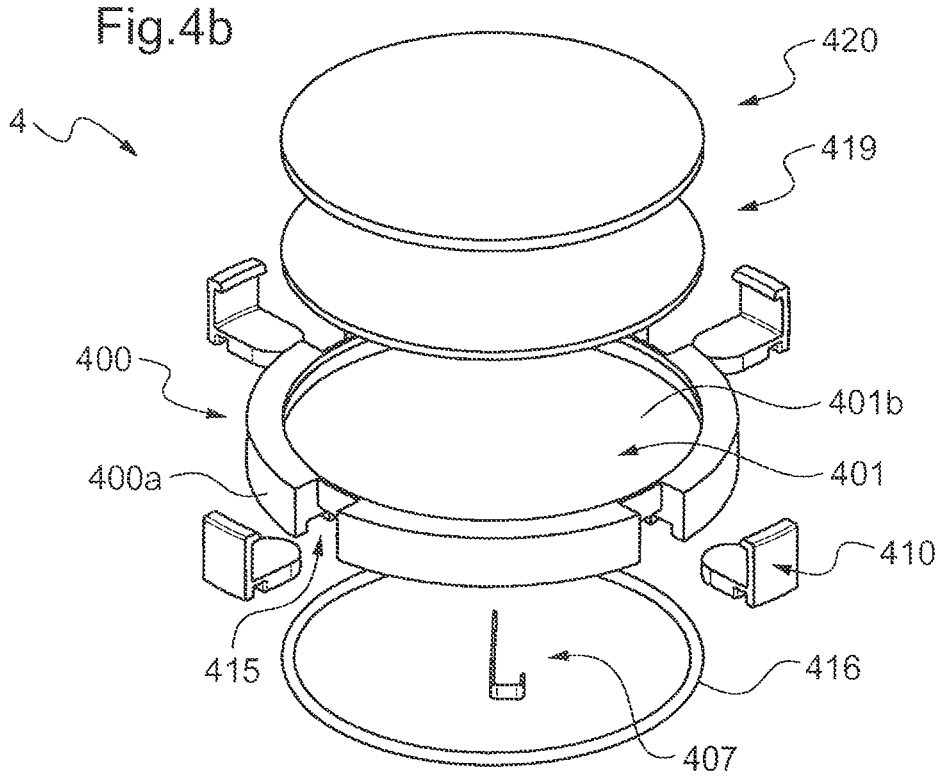
Figure 5:
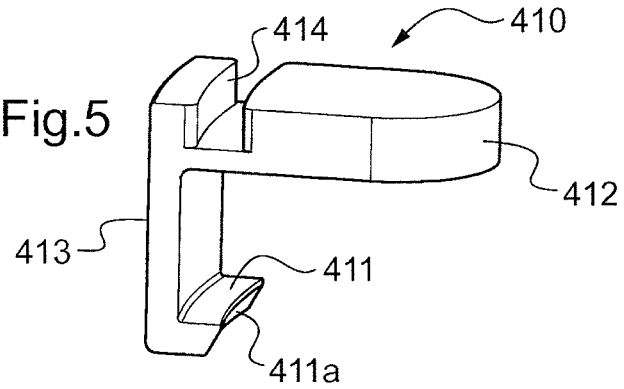
FIG. 5 presents a first exemplary embodiment of a coupling member according to a first embodiment of the invention.
Figure 6:
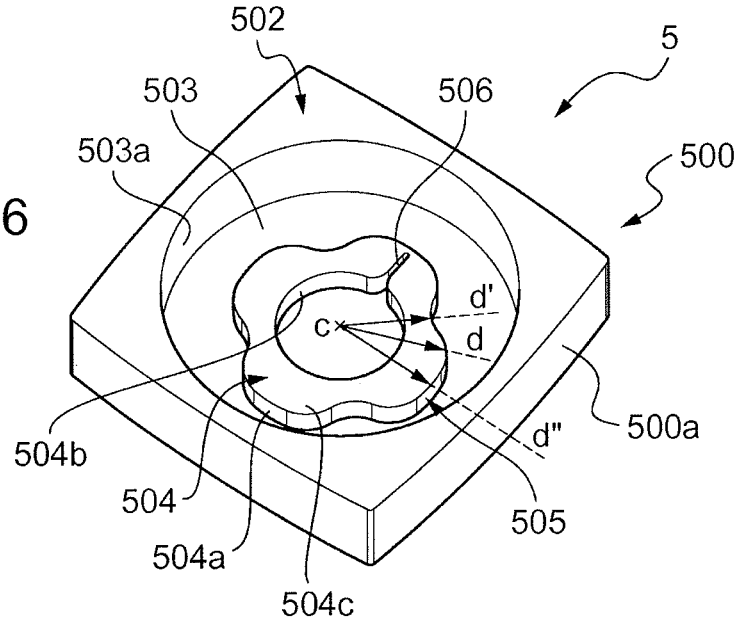
FIG. 6 presents a view of the inside, or from below, of a cap of the lid of FIG. 1 according to a first embodiment of the present invention and which is adapted to cooperate with the coupling plate of FIGS. 3 and 4.

As FIGS. 3 to 6 show, the lid 3 comprises a coupling plate 4, represented in FIG. 3 in accordance with a first exemplary embodiment of the present invention, which is covered by a cap 5, represented in FIG. 6 according to a first exemplary embodiment of the present invention.

The cap 5 and the coupling plate 4 cooperate to enable easy opening and reliable closing of the pot 1 in use.

For this, the coupling plate 4 comprises a support 400.

Whatever the outside shape of the pot 1, the support 400 can have a wall contour 400*a* of a solid of revolution in order to promote rotation in relation to the cap 5. Thus, the support 400 here has a generally cylindrical shape.

The support 400 also comprises a closing plate 401 comprising a face referred to as upper face 401*a* provided to be oriented towards the cap 5, and a face referred to as lower face 401*b*, which is substantially parallel to the upper face 401*a*, and provided to be oriented towards the base 2 (these are visible for example in FIGS. 4*a* and 4*b*).

The support 400 is formed from any appropriate material, in particular of metal by machining or of plastic by molding, with, for example, the upper face 401*a* being substantially planar.

On the same side as the upper face 401*a*, the support 400 here comprises a central stud 403 formed in relief in relation to the upper face 401*a*. The central stud 403 is of generally cylindrical shape, such that an outside contour surface 403*a* of the central stud 403 is substantially parallel to at least one cylindrical part of the contour wall 400*a* of the support 400. In other words, the central stud 403 is advantageously centered on the upper face 401*a* of the support 400; the contour surface 403*a* of the central stud 403 and the contour wall 400*a* of the support 400 are here two concentric cylinders, with the contour surface 403*a* of the central stud 403 having a smaller radius than the radius of the contour wall 400*a* of the support 400. The central stud 403 is advantageously configured to form a pivot for rotation of the cap 5 which is described below.

Figure 13:
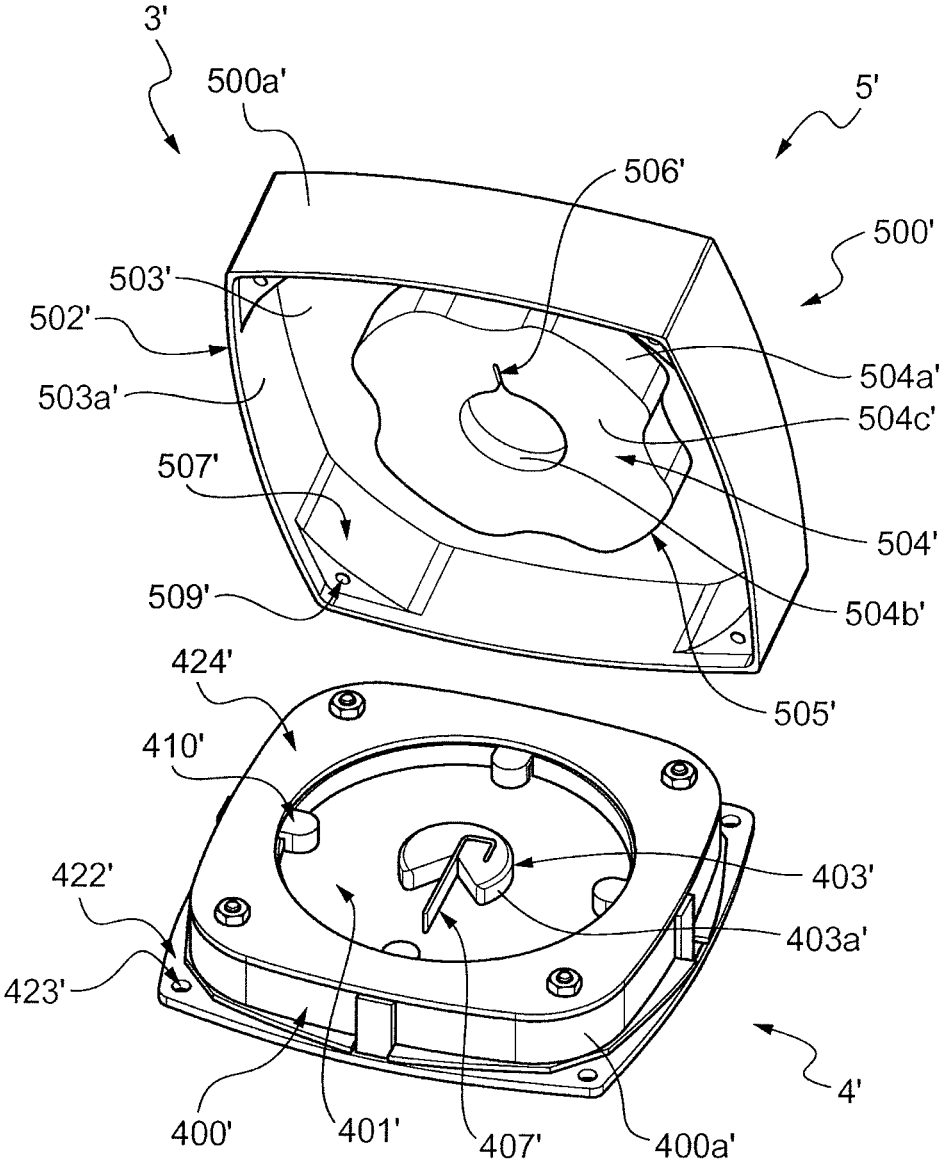
FIG. 13 presents a coupling plate and a cap of the lid of FIG. 10 according to a second embodiment of the present invention and separated from each other.

The central stud 403 here comprises a slot 404. The slot 404 is formed here of two parts. A first part 405, here U-shaped (or C-shaped), is of uniform width, and a second part 406 is of wider form, here flared with widening starting from the first part 405. The slot 404 is provided to receive an elastic position return member 407 serving to bring the cap 5 back into resting position in relation to the coupling plate 4 when the cap 5 is turned in relation to the coupling plate 4. The position return member 407 is for example a blade spring here. Furthermore, the slot 404 is positioned here in relation to the central stud 403 so as to pass via a central axis of the central stud 403 which is the geometrical central axis of the cylinder represented by the contour surface 403*a* of the central stud 403. The blade spring 407 can be of uniform thickness and height. It is for example inserted into the slot 404, which makes it possible to avoid recourse to other fastening or assembly means for example such as adhesive. The blade spring 407 is furthermore composed here of a first curved part of complementary shape to the first part 405 of the slot 404, that is to say U-shaped (or C-shaped), and of a second part, which is straight here. Thus, the blade spring 407 is embedded in the central stud 403 by virtue of the first part 405 of the slot 404, and its second part has a possibility of movement in the second part 406 of the slot 404. To ensure better support and better stability of the blade spring 407 in relation to the central stud 403, and thereby in relation to the support 400, the width of the first part 405 of the slot 404 can be equal to the thickness of the blade spring 407. Lastly, the blade spring 407 can be of a length such that it extends beyond the contour surface 403*a* of the central stud 403, which enables the blade spring 407 to cooperate simultaneously with a slot 506 of the cap 5 here to fulfill its role of position return member as described below. Furthermore, in this exemplary embodiment, a free end of the spring blade 407, that is to say that which extends beyond the central stud 403, is situated in the middle of two coupling members 410. It could however be situated facing a coupling member as shown in FIG. 13.

On the same side as the upper face 401*a*, the support 400 comprises a raised portion 408 which here juxtaposes the contour wall 400*a*.

Still on the same side as the upper face 401*a*, the support 400 further comprises an annular groove 409.

The annular groove 409 is hollowed out of the raised portion 408. The groove 409 here is channel-shaped and generally describes a circle of which the center is identical to that of the support 400.

To grasp the lid 3 of the base 2, the coupling plate 4 comprises at least one coupling member 410. In the present exemplary embodiment, it comprises four identical coupling members 410, positioned at equal distances from each other, that is to say here every 90°, at the periphery of the support 400.

To that end, the plate 4 comprises for example one space 415 per coupling member 410, i.e., four spaces 415 here. Thus, here, the spaces 415 are positioned at equal distances from each other and are all identical.

Each space 415 here creates a discontinuity in the contour wall 400*a* as well as in the raised portion 408 and therefore in the groove 409. The raised portion and the groove thus here comprise four parts which are all identical.

Each of the coupling members is housed in one of the spaces 415 which slidingly guides it radially.

As FIG. 5 shows more specifically, each coupling member 410 comprises a claw 411 and a cam follower 412. In the present exemplary embodiment, the claw 411 and the cam follower 412 extend from the same face of a dorsal wall 413 of the coupling member 410, and are oriented towards the center of the support 400 once the coupling member 410 has been mounted on the support 400. The coupling member 410 is thus C-shaped.

The claw 411 is thus configured to grasp the neck 201 of the base 2 by engaging in the indentation 202 under the rim 204. The claw 411 here has the form of a distinct rim curved towards the center of the support 400. Furthermore, the claw 411 here has a bevel 411*a* that is configured to cooperate with the rounded formation of the rim 204 to facilitate passing round the rim 204 by the claw 411 on its engagement in the indentation 202 when, for example, the lid is clipped on to close the pot. Lastly, the claw 411 here has a free end that is rounded to be consistent with the circular perimeter of the neck 201, with which is it provided to cooperate.

Each coupling member 410, comprising a claw 411, a cam follower 412 and a dorsal wall 413, is can be formed as one piece, for example of metal or by molding of plastic material.

The cam follower 412 is lobe-shaped here in a plane parallel to the upper face 401*a* of the support 400 and is of uniform thickness.

In general, the cam follower 412 can have a shape that is rounded in a plane parallel to the upper face 401*a* and symmetrical in relation to a median plane of the cam follower 412 that is orthogonal to the upper face 401*a*, in order to ensure regular movement whatever the direction of rotation of the cap 5 in relation to the coupling plate 4.

Between the cam follower 412 and the dorsal wall 413, a groove 414 is formed here. The groove 414 of each of the coupling members 410 is configured to be located in alignment with the portions of annular groove 409, so as to form a continuous groove when the coupling members 410 are in place in the spaces 415. The width of the annular groove 409 is here greater than that of the grooves 414 of the coupling members 410. It is at least substantially equal to the width of the groove 414 increased by the amplitude of movement of the coupling members 410 between a first resting position and a second opening position of the pot. This amplitude of movement is determined by the cam profile 504 of the cap 5 which is described below. This for example makes it possible to avoid subjecting the coupling return member 416 to pinching or shear.

As shown by FIG. 3, a coupling return member 416 is disposed in the portions of annular grooves 409 and the grooves 414 of the coupling members 410. The coupling return member 416 is engaged in the grooves 414 without radial play. By deforming elastically, it is able to move in the portions of groove 409 of which the width is greater towards the outside. The coupling return member 416 is thus linked to each coupling member 410 and to the support 400 and enables them to be held in position in relation to each other. The coupling return member 416 here returns the coupling members 410 towards the center of the plate 4. The dorsal wall 413 of each coupling member 410 then comes to bear against a perimeter of the closing plate 401 in the spaces 415. Furthermore, the coupling return member 416, which is for example an elastic ring here, is possibly bonded over at least one portion of groove 409, for example towards the inside, to promote and facilitate good maintenance in position of the coupling return member 416 and thus the return of the members 410.

Two positions of operation are thereby defined for the coupling members 410. In a first position, referred to as a resting or closing position of the pot, the coupling return member 416 bears against an edge of small diameter of the portions of groove 409 and it holds the coupling members 410 in their position moved towards the center of the plate 4. In a second position, referred to as an opening position of the pot, the coupling members 410 are moved away from the center of the plate. In doing this, they stretch the coupling return member 416 by driving it towards the large diameter edge of the portions of groove 409. The claws 411 of the coupling members 410, the grooves 414 and the portions of groove 409 are configured in order for the free ends of the claws, in the first position, to be situated inside an imaginary circle of which the diameter would be the maximum diameter of the rim 204 of the base and, in the said position, for the free ends of the claws to be situated outside that imaginary circle.

The coupling return member 416 is for example here an elastic ring, for example a ring of rubber, but any other elastic return means may also be employed within the scope of the invention. For example, the coupling return member 416 could comprise one or more blade springs disposed in the grooves 414 and the portions of groove 409, or for instance tension springs which would link the coupling members 410 to the central stud 403 and are configured to return the coupling members 410 automatically towards the center of the plate.

The coupling plate 4 further comprises here an obturator plate 419 (shown in FIGS. 4*a*, 4*b* and 8 for example), coupled under the closing plate 401, on the same side as the inside face 401*b*.

The obturator plate 419 is furthermore generally covered by a compressible planar seal 420, having a thickness of a few tenths of a millimeter, provided to be compressed on its perimeter between the obturator plate 419 and the rim 204 of the neck 201 of the base 2. The planar seal 420 is formed of any appropriate elastically compressible material, in particular of polyethylene, SEBS, elastomer or any other equivalent material. As there is very little or no relative rotation between the coupling plate and the neck, the planar seal 420 is not acted on, or is very little acted on, in shear, and it is possible to choose a relatively adherent material which has a high coefficient of friction.

Instead of such a compressible planar seal 420, the obturator plate 419 mounted on a suspension and adorned with a seal of reduced thickness may be employed, as is described for example in patent application FR 2969127.

FIG. 6 presents a cap 5 according to a first exemplary embodiment of the present invention. The cap 5 is here composed of a body 500. The body 500 comprises an upper face 501 (shown in FIG. 1), a bottom 503, at the back of the upper face 501, and a contour wall 502.

The upper face 501 here constitutes an outside face, provided for example to be visible to a user when the pot 1 is closed. The upper face 501 is for example customizable, it is configured to receive decoration, for example in the form of varnish. According to an option not shown, the upper face is formed by one or more additional layers of openwork which are superposed in order to constitute the decoration, or for instance by an additional layer of marquetry. It may be produced from plastic, wood, glass or other materials. The upper face 501 is for example planar or domed.

The contour wall 502 extends from adjacent the bottom 503.

It comprises an outside contour surface 500*a* which advantageously has the same shape as the outside contour of the base 2, and an inside contour surface 503*a*. Furthermore, the outside contour surface 500*a* is positioned at the periphery of the upper face 501; it is tangential to an edge of the upper face 501. The bottom 503 can be substantially at a right angle to the inside contour surface 503*a* and outside contour surface 500*a*. The inside contour surface 503*a* can have a circular shape, at least in part, that is to say that, at least in part, it forms a cylinder, with a diameter substantially equal to the diameter of the support 400 such that the cap 5 can pivot in relation to the coupling plate 4.

Independently of the shape of the outside contour surface 500*a* of the cap 5, the inside contour surface 503*a* can be centered in relation to the cap 5. In other words, here, a central axis of the cylinder formed by the inside contour surface 503*a* extend along a geometric center C of the cap 5.

The cap 5 further comprises a radial cam 504. The radial cam 504 is here formed by a relief of additional thickness on the bottom 503. The radial cam 504 here has a bearing face 504*c*, an outside contour surface 504*a* and an inside contour surface 504*b*. In the present exemplary embodiment, the bearing face 504*c* is substantially at a right angle to the outside contour surface 504*a* and to the inside contour surface 504*b*, and substantially parallel to the bottom 503. The inside contour surface 504*b* can define a cylindrical envelope parallel to the inside contour surface 503*a*. Furthermore, a diameter of the inside contour surface 504*b* is substantially equal to the diameter of the central stud 403 of the support 400 in order for the stud 403 to be able to be housed in a hollow defined by the inside contour surface 504*b* such that the cap 5 can pivot in relation to the coupling plate 4.

The outside contour surface 504*a* defines a profile forming at least one projecting active zone 505. Thus, the radial cam 504 is a radial cam with an outside profile. Here, it comprises four projecting active zones 505, one projecting active zone 505 per coupling member 410.

Each projecting active zone 505 is defined here by an angular portion of the radial cam 504 between two successive positions in which a radius of the radial cam 504 is equal to a distance between the outside contour surface 504*a* and the center C of the cap 5 which is a minimum. In other words, a projecting active zone 505 presents a distance d between the outside contour surface 504*a* and the center C of the cap 5 which is greater than the minimum distance d' and which successively increases and decreases along the angular portion up to at least one position from which the distance d begins to increase again.

In the present exemplary embodiment, as the radial cam 504 is in particular centered in the cap 5, it presents four positions in which the distance d between the outside contour surface 504*a* and the center C of the cap 5 is minimum, furthermore equal here to the distance d'. Between two of these consecutive positions, the distance d between the outside contour surface 504*a* and the center C of the cap 5 is greater until a maximum d" is reached and makes it possible to define an apex of a projecting active zone 505. Each projecting active zone 505 thus presents an apex which corresponds to a position at a radius at which the distance between the outside contour surface 504*a* and the center C of the cap 5 is maximum (and is thus equal to the distance d"). The distance d between the outside contour surface 504*a* and the center C of the cap 5 can change in the same way on respective opposite sides of the apex of a projecting active zone 505 until it reaches a position of distance d' in relation to the center C. In other words, each projecting active zone 505 here comprises a plane of symmetry.

In the present exemplary embodiment, the radial cam 504 thus has substantially the shape of a cross with rounded branches or that has four lobes of regular profile. The radial cam 504 for example here has eight planes of symmetry. In other words, here, all the projecting active zones 505 are identical.

Thus, the distance d' defines the first position of the coupling members 410, and the distance d" defines their position of maximum remoteness. It is thus possible to configure, between these two positions, a position enabling the opening of the pot. In practice, this position can be advantageously close to the first position. This in particular makes it possible to constitute a safeguard in case of wear of the cam.

For example, a variation of distance necessary for the opening of a pot, that is to say to clear a claw from the indentation, corresponds to approximately 1.5 mm.

The cap 5 furthermore comprises a slot 506. The slot 506 is here hollowed into the relief of additional thickness forming the radial cam 504. The slot 506 here comprises a single entry at its end adjacent the inside contour surface 504*b*. That is to say it is blind at its other end. The slot 506 here furthermore has a flared shape at its entry. According to another exemplary embodiment not shown, it could comprise another entry at its other end adjacent the outside contour surface 504*a*, flared or not flared, that is to say it could pass through the additional thickness forming the radial cam 504. The dimensions of the slot 506 are provided in order for the slot to receive the free end of the blade spring 407. Furthermore, in the exemplary embodiment of FIG. 6, the slot 506 is formed in a plane of symmetry of a projecting active zone 505 of the radial cam 504. In the exemplary embodiment of FIG. 13, it is on the contrary formed between two projecting active zones.

Thus, when the cap 5 and the coupling plate 4 are assembled (as for example shown by FIGS. 8 and 9), the contour wall 400*a* of the support 400 of the coupling plate 4 faces the inside contour surface 503*a* of the cap 5 and the cam follower 412 of each coupling member 410 is in contact with the outside contour surface 504*a* of the radial cam 504. The free end of the blade spring 407 which extends beyond the contour surface 403*a* of the central stud 403 of the plate 4 is simultaneously inserted into the slot 506 of the cap 5 to provide here its role of position return member.

The lid 3 is then configured to adopt a "resting" position and an "opening" position.

The assembly between the cap 5 and the coupling plate 4 is achieved by any appropriate means, for example by a circlip that retains the coupling plate 4 inside the cap 5, or for instance by snap engagement of the coupling plate 4 in the cap 5.

In resting position, the cap 5 and the coupling plate 4 are oriented in relation to each other such that the cam follower 412 of each coupling member 410 is positioned between two consecutive projecting active zones 505, as shown for example by FIG. 9, that is to say facing a position on the outside contour surface 504*a* of the radial cam 504 at a distance d' from the center C of the cap 5. Each coupling member 410 is then in a position, referred to as first position. The ends of the claws 411 are then located inside the imaginary circle of which the diameter would be the maximum diameter of the rim 204 of the base 2. The lid occupies this resting position when it is placed on the base 2, as for example illustrated by FIG. 8, or when it is detached from the base 2 of the pot, without any rotational force being applied between the plate 4 and the cap 5.

The coupling return member 416 as well as the position return member 407 of the cap 5 in relation to the coupling plate 4, are then in a natural configuration, of minimum deformation, also referred to as "resting" configuration. Furthermore, the slot 506 of the cap 5 is aligned here with at least a part of the slot 404, which is part 406 here, such that the position return member 407 is not deformed.

To attain the opening position from the resting position, the cap 5 is turned in relation to the coupling plate 4. Each cam follower 412 moves along a corresponding projecting active zone 505 until it attains a predetermined distance in relation to the center C enabling the pot 1 to be opened. The predetermined distance corresponds to a predetermined angle of rotation between the cap 5 and the coupling plate 4. The predetermined distance is for example the whole distance d comprised between d' and d".

In the present exemplary embodiment, distance d" corresponds to a rotation of 45° in relation to the resting position. Thus, for a distance d comprised between d' and d", the angle of rotation would be comprised between 0° and 45° for example. Thus, the predetermined distance may be fixed so as to have to apply a rotation of approximately 40°, or even of approximately 30°, or for instance approximately 15° or 10° to the cap 5 in relation to the coupling plate 4 for example. Each coupling member 410 then has a retracting movement, that is to say it moves away in relation to the center C, it translates in a radial direction. The groove 414 of each coupling member 410 progressively shifts which deforms the coupling return member 416, and simultaneously the position return member 407 is deformed by bending because it remains inserted both in slot 404 and in slot 506. The flared shapes of the slots thus make it possible to avoid local deformations that are too great. Such deformations could engender irreversible deformations of the blade for example.

In opening position, each coupling member 410 has then reached a second position which is translated in relation to the first position, in which the claws 411 are located outside the imaginary circle mentioned above, and the coupling return member 416 as well as the position return member 407 tend to bring the lid automatically back into resting position.

Such a lid 3 is thus easily adaptable to any base 2, provided to contain a cosmetic product, comprising a neck 201 with at least one peripheral indentation 202.

When the lid 3 is assembled on the base 2 such that the pot 1 is closed, the claw 411 of each coupling member 410 of the lid 3 is engaged in the at least one indentation 202 of the neck 201 of the base 2 while the lid 3 is in resting position.

Opening the pot 1 requires turning the lid 3 in relation to the base 2. Pivoting the lid 3 here engenders pivoting of the cap 5 in relation to the coupling plate 4 which results in translating each coupling member 410 and thus in clearing each claw 411 from its indentation 202, here by moving each claw 411 away from the outside contour surface of the neck 201. As soon as each cam follower 412 has attained the predetermined distance in relation to the center C, corresponding to a predetermined angle of rotation of the cap 5 in relation to the coupling plate 4, each claw can then pass around the rim 204.

To attain this open position, the coupling plate 4 can be braked or even retained, rotationally, either by simple friction or adherence in relation to the neck 201, or else, where provided, by the fact that one of the claws 411 is stopped against a rib 203 of the indentation 202.

By convenience where provided, the rib 203 can have a thickness substantially equal to a depth of the indentation 202 in relation to the rim 204 such that a claw 411 is incapable of passing over the rib 203 so long as it is unable to disengage from under the rim 204.

In the present exemplary embodiment, the base 2 comprises a rib 203. But, according to other examples, not shown, the base 2 could comprise four ribs such that each claw 411 of the lid 3 described above bears against a rib in a direction of rotation of the lid. In this last configuration, two consecutive ribs are for example spaced away from each other by a distance equal to a width of a claw in order for the latter to be angularly locked in each direction. According to another example not shown, the base comprises at least one rib which extends along a circumference of the neck over a distance equal to a spacing defined between two coupling members or two sides of a same coupling member such that the coupling plate is then locked in orientation in each direction of rotation. In a case in which the lid only comprises a single claw 411, the indentation 202 could for example be defined on the neck 201 by a recess in which the claw 411 engages when the lid is in resting position. In another case in which the lid comprises at least two claws 411, at least one rib 203 extends for example between two consecutive claws 411. It is of course possible to combine these different configurations.

Such a pot 1 as described above is for example easily closed by clipping the lid 3 on the base 2 for example, that is to say by pressing the lid onto the base in such a way that the claws pass the rim 204 of the neck. The rounded formation of the neck and the bevel 411*a* of the claws facilitate this operation. Once the rim has been passed, the claws adopt their closed position of the pot under the action of the coupling return member 416. This movement is in general accompanied by a snapping sound that informs the user that the pot is properly closed.

Figure 7:
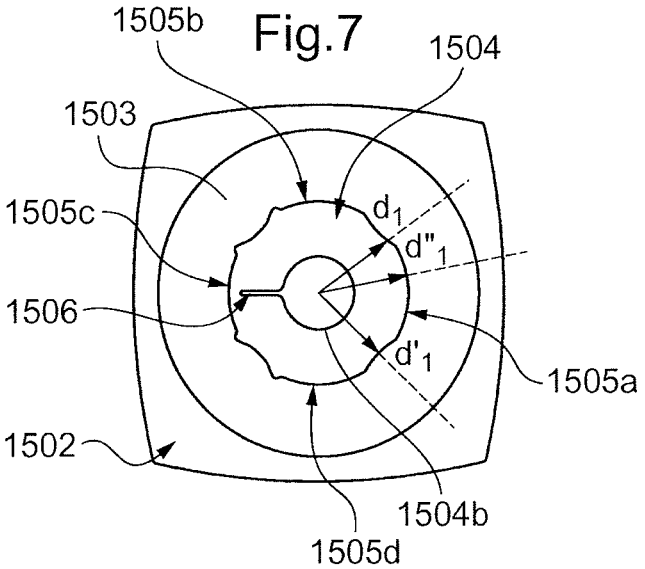
FIG. 7 presents an alternative embodiment of a radial cam of a cap.

By way of example, FIG. 7 presents a variant embodiment of the cam of the cap of the lid.

In this variant, similar parts to the aforementioned comprise the same numerical reference increased by 1000. In this example, the radial cam 1504 comprises four projecting active zones identified as 1505*a*, 1505*b*, 1505*c* and 1505*d*. Here, the projecting active zones differ from each other. The projecting active zones 1505*a*, 1505*b*, 1505*c* and 1505*d* each here comprise a flattened apex forming a neutral zone, defined by a constant distance $d''_1$ to the center, and a transitional zone on respective opposite sides of the neutral zone, at which the distance $d_1$ from the center is variable and less than or equal to $d''_1$. Each transitional zone thus has a minimum radius $d'_1$ which here corresponds to the closing or resting position of the claws whereas the distance $d''_1$ corresponds to the opening position of the pot. Preferably, at least one joint between a transitional zone and a neutral zone, the radial cam comprises a discontinuity that thus forms a joining zone and defines a break in the slope of the profile. Furthermore, here, the projecting active zones 1505*b* and 1505*d* have a discontinuity in relief, and the projecting active zone 1505*c* has its two discontinuities in relief. However, the discontinuities could, on the contrary, be of recessed form. The discontinuities in relief create a point of increased resistance in the rotation of the cap in relation to the coupling plate. Once the claws have passed over a discontinuity in relief (or have dropped into a discontinuity in recessed form) the cap remains in a stable angular position in relation to the coupling plate, and the claws stay in their opening position. In the present exemplary embodiment, there is a discontinuity in relief on opposite sides of the neutral zones formed by the projecting active zones 1505*b* and 1505*c* and by the projecting active zones 1505*c* and 1505*d*. This not only enables the same effect to be produced whatever the direction of rotation applied to the cap in relation to the plate but also to safeguard that effect in case of wear of one of the discontinuities in relief.

To close the pot, the user places the lid on the base with the plate which adheres to the upper surface of the neck and turns the lid, inducing rotation of the cap in relation to the plate, in the opposite direction to that which caused the opening in order for the claws to pass over the point of increased resistance in the opposite direction. The spring blade contributes to bringing the cap into its resting position. If by accident the lid returns to resting position while the lid is not positioned on the pot, the pot is closed in the same manner as that described above, that is to say by clipping on.

FIGS. 10 to 18 present a pot according to a second embodiment of the present invention.

In these Figures, similar parts to those presented with reference to the first embodiment comprise the same numerical references increased by a "prime" and are not therefore described again.

The pot according to this embodiment thus differs from the preceding one in particular by the following features.

As shown by FIGS. 11 and 12, the neck 201' of the base 2' here is of generally square shape having a wide opening. In the illustrated embodiment, the base is for example considered lacking any upper shoulder, in contrast to the base of the first embodiment. That is to say that the neck 201' is then situated directly extending onwards from the base and that it has a square shape itself. By way of illustration, the pot represented has a square base with sides of approximately 70 millimeters, with an opening having sides of approximately 55 millimeters, a wall thickness of approximately 7.5 millimeters on average and a neck having a height of approximately 3 millimeters. This however is not limiting, and it would be entirely possible to produce a square pot with a square opening, but with smaller dimensions of the opening and thus the presence of shoulders on the upper surface of the base. What is important here by way of example is that the neck and the opening are not circular.

Figure 15:
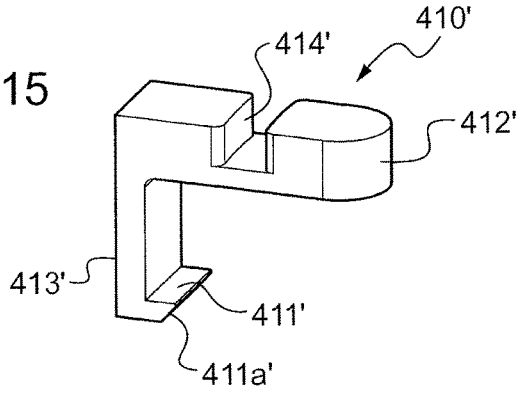
FIG. 15 presents a coupling member according to a second embodiment of the invention.

The neck 201' here comprises four indentations 202' separated by ribs 203', forming orientation stops, extending along the perimeter of the neck 201' such that each indentation 202' is substantially centered in relation to a side of the neck 201' of substantially square shape and has a length substantially equal to a height of a coupling member 410', presented for example in FIG. 15.

As a consequence, as shown by FIG. 13, not only is the lid 3' of substantially square shape, corresponding to the substantially square shape of the base 2', but the coupling plate 4' furthermore here is of substantially square shape.

The pivot between the coupling plate 4' and the cap 5' is then formed here by the outside contour surface 403*a'* of the central stud 403' cooperating with the inside contour surface 504*b'* of the radial cam 504', and furthermore by part of the outside contour wall 400*a'* comprising rounded corners and the inside contour surface 503*a'* of the contour wall 502' of the cap 5' provided with reinforcements 507'.

Each of the coupling members 410' is positioned substantially in the middle of one side of the coupling plate 4'.

Therefore, the radial cam 504' is oriented here in the cap 5' such that each of its four projecting active zones 505' faces a corner of the cap 5'.

Furthermore here, by way of example, the free end of the blade spring 407', that is to say that which extends beyond the central stud 403', is situated facing one of the coupling members 410', and therefore, the slot 506' formed in the radial cam 504' is positioned between two projecting active zones 505'.

FIG. 15 presents a coupling member 410' according to a second exemplary embodiment. It differs from the preceding one in that the groove 414', even though positioned between the cam follower 412 and the dorsal wall 413 and configured to be located as a continuation of the portions of annular groove 409', is further away from the dorsal wall 413' here. Furthermore, the free end of the claw 411 is straight here, to be consistent with the perimeter of the neck 201' facing which it is provided to be positioned.

Figure 14:
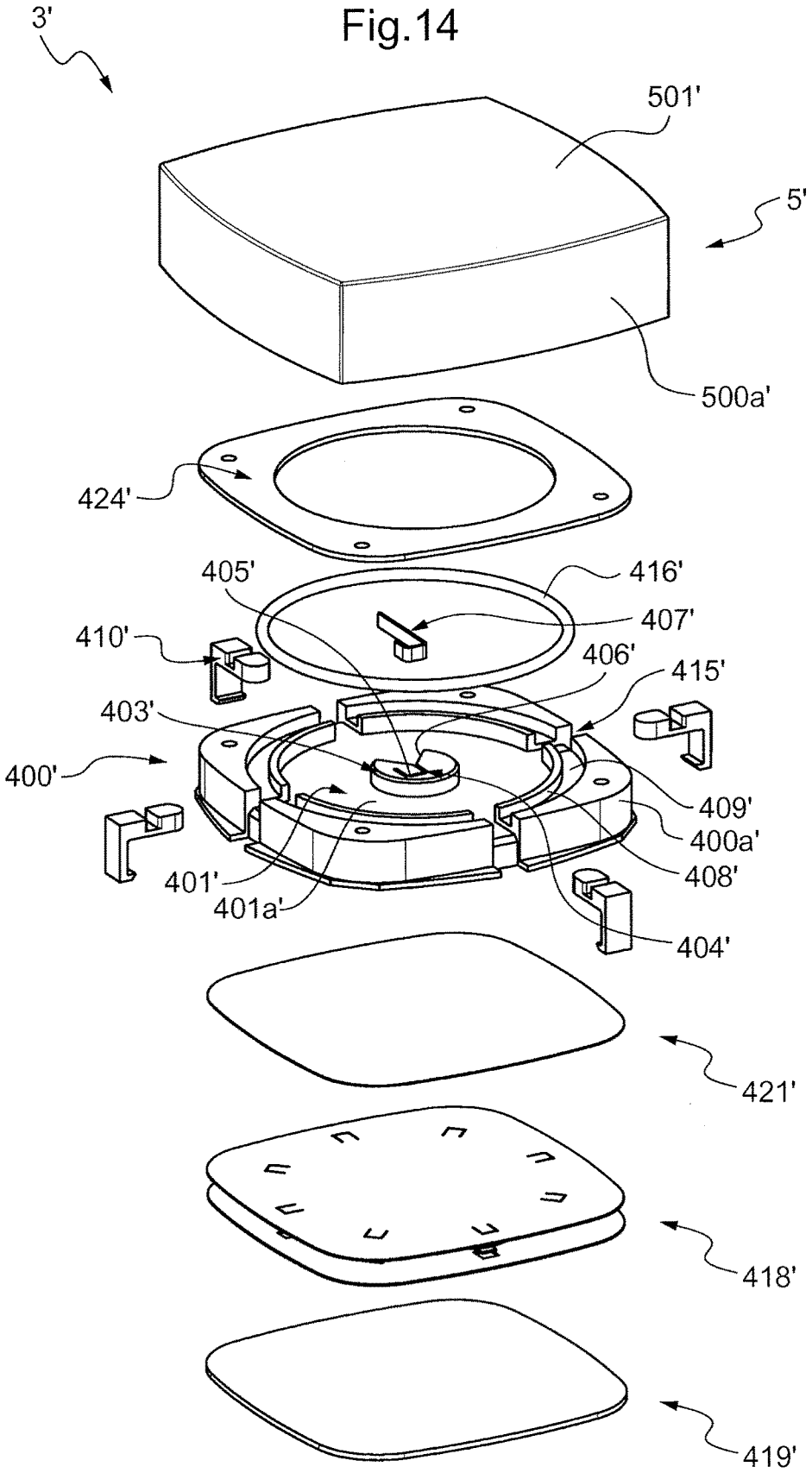
FIG. 14 presents an exploded view of the lid of the pot of FIG. 10.

As shown by FIGS. 13 and 14 in particular, the plate 4' here comprises an optional small plate 424', which enables the coupling members 410' and the coupling return member 416' to be held in position on the support 400' when the plate 4' and the cap 5' are assembled.

Figure 16:
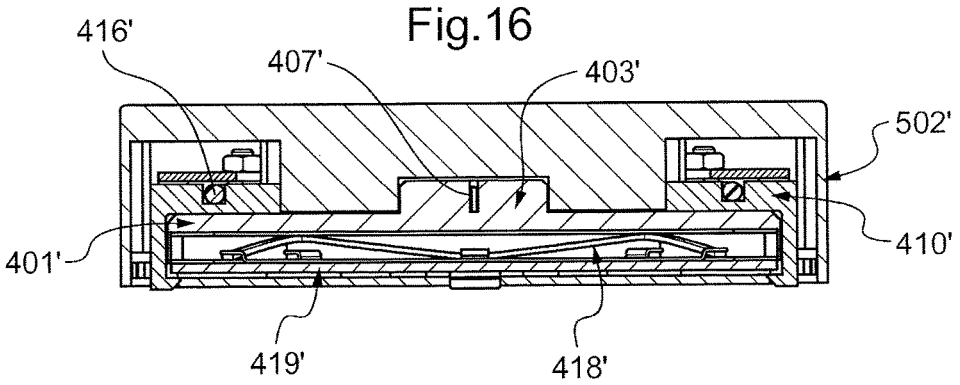
FIG. 16 illustrates a cross-section view on the plane XVI shown diagrammatically in FIG. 17 of the lid of the pot of FIG. 10.

FIGS. 14 and 16 here show that the lid 3' further comprises a return spring of the obturator plate 418', which for example comprises a corrugated washer held between two membranes. The return spring of the obturator plate 418' is for example sandwiched between the obturator plate 419' (which may possibly be covered with a seal in the form of a membrane for example) and the closing plate 401'. Possibly, an intermediate plate 421', as shown for example in FIG. 14 but not shown in FIG. 16, is possibly added between the return spring of the obturator plate 418' and the closing plate 401'.

Thus, once the pot has been closed, while the obturator plate 419' bears against the rim 204' of the neck 201', generally with the seal pinched at its perimeter between the rim 204' and the obturator plate 419', the return spring of the obturator plate 418' tends to push the closing plate 401' back, that is to say to move the closing plate 401' away in relation to the obturator plate 419' and thus from the rim 204', which results in forcing the claws 411' of each coupling member 410' to bear under the rim 204' when these latter are engaged in the indentations 202'.

Figure 17:
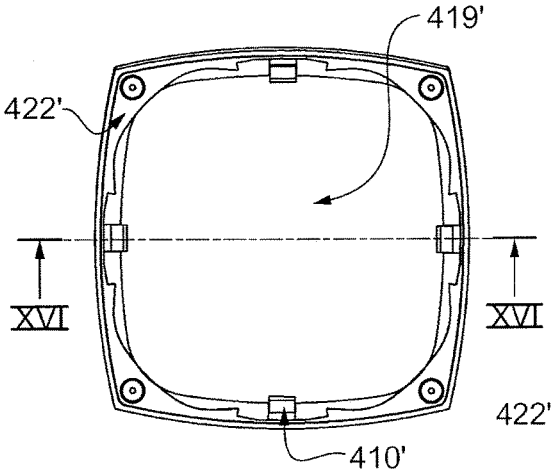
FIG. 17 presents a view from below of the lid of pot of FIG. 10 in resting position.
Figure 18:
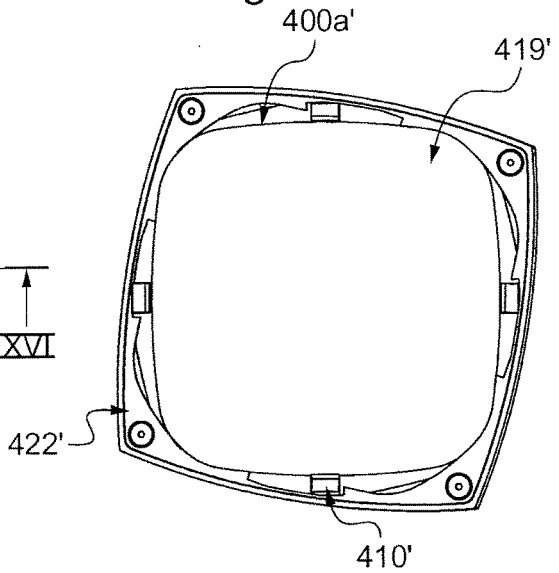
FIG. 18 presents a view from below of the lid of pot of FIG. 10 in opening position.

Lastly, FIGS. 17 and 18 show in a view from below the respective positions of the coupling plate 4' and of the cap 5' according to whether the lid 3' is respectively in resting position or in opening position.

Tapped blind holes 509', present in the corners of the cap 5' of substantially square shape, in particular here in the reinforcements 507', are thus configured to receive, for example, screws to assemble the plate 4' to the cap 5'. To that end, the plate 4' here comprises a flange 422' comprising holes 423' configured to be passed through for example by the screws provided to be accommodated in the tapped holes 509'.

Furthermore, as made apparent by FIG. 13 and FIGS. 17 and 18, the inside contour surface 503*a'* which defines the housing for the coupling plate does not have the shape of a cylinder of revolution here. Its shape is provided in order for the obturator plate to be able to oscillate through an angle of approximately 15° on either side of a median position which corresponds to the resting or closing position of the pot. In the closing position of the pot, the contour of the cap 5' is aligned with that of the base. The contour of the neck of which the shape substantially matches the outside contour of the obturator plate takes this feature into account.

The opening and the closing of the pot are made in accordance with the same operating procedure as that which has been described for the first embodiment, except for the fact that on opening the pot the ribs 203' retain the claws 411' of the coupling members 410' on rotation of the cap. Also, on closing, the user must place the cap in angular coincide with the base in order for the claws 411' of the coupling members 410' to enter the indentations 202'. It is also possible to provide for this embodiment the same construction variant of the radial cam as that described above with reference to FIG. 7. Moreover, this embodiment applies to any non-circular shape of neck.

Naturally, the present invention is limited neither to the preceding description nor to the appended drawings, but encompasses any variant form within the capability of the person skilled in the art.

The invention claimed is:

1. A cosmetic pot comprising:

a base comprising a neck provided with at least one peripheral indentation; and a lid configured to close the base, said lid comprising:

an inside part comprising a coupling plate; and an outside part comprising a cap;

the coupling plate and the cap being rotatably mounted in relation to each other, such that the lid is configured to adopt a resting position and an opening position and the coupling plate and the cap are turned in relation to each other in relation to the resting position;

the cap comprising a radial cam, the radial cam being defined by a profile forming at least one projecting active zone;

the coupling plate comprising:

a support;

at least one coupling member mounted on the support and movable in translation in relation to the support;

the at least one coupling member comprising a claw and a cam follower, the cam follower being in contact with the radial cam of the cap;

the at least one coupling member being configured to adopt at least a first position when the lid is in the resting position and a second position when the lid is in the opening position;

the second position being a position in which the cam follower of the coupling member cooperates with the at least one projecting active zone of the radial cam and in which the at least one coupling member, in the second position, is configured to be translated in relation to the first position; and at least one coupling return member linked to the at least one coupling member and to the support, the at least one coupling return member being configured to automatically return the at least one coupling member to the first position; and the claw of the at least one coupling member of the lid being engaged in the at least one indentation of the neck of the base when the lid is in the resting position and the pot is closed.

2. A pot according to claim 1, wherein:

the lid comprises a position return member; and the position return member is linked to the support of the coupling plate and is linked to the cap, such that the position return member is in a neutral configuration when the lid is in the resting position, and in a deformed configuration when the lid is in the opening position, such that the position return member is configured to induce a counter-rotation of the cap in relation to the coupling plate when the lid is in the opening position so as to bring the lid automatically back into the resting position.

3. A pot according to claim 2, wherein:

the position return member is a blade held in a slot formed in the support of the coupling plate and also held in a slot formed in the cap.

4. A pot according to claim 1, wherein:

the radial cam is a cam with an outside profile.

5. A pot according to claim 1, wherein:

the at least one projecting active zone of the radial cam has a plane of symmetry such that the cap and the coupling plate of the lid are configured to turn in relation to each other in a clockwise or anticlockwise direction.

6. A pot according to claim 1, wherein:

the lid comprises at least two coupling members movable in translation, each of the coupling members comprising a claw and a cam follower in contact with the radial cam of the cap;

the cam comprises at least two projecting active zones;

each of the coupling members is configured to adopt a first position when the lid is in the resting position and a second position when the lid is in the opening position; and the second position of each of the coupling members is a position in which the cam follower of each of the coupling members cooperates with a corresponding projecting active zone of the radial cam and in which each of the coupling members, in the second position, is translated in relation to the first position when the lid is in the opening position.

7. A pot according to claim 6, wherein:

the lid comprises a single coupling return member configured to return at the same time each of the at least two coupling members automatically to the first position.

8. A pot according to claim 1, wherein:

the base comprises at least one rib configured to keep the coupling plate of the lid oriented in relation to the base when the at least one coupling member is in the first position.

9. A pot according to claim 1, wherein:

the at least one projecting active zone is configured to form a stable opening position.

* * * * *